United States Patent [19]

Townsend

[11] Patent Number: 4,618,201

[45] Date of Patent: Oct. 21, 1986

[54] CONNECTOR FOR ESTABLISHING ELECTRICAL CONTACT WITH A HIGH COUNT TWISTED PAIR CABLE

[75] Inventor: Peter K. Townsend, Camp Hill, Pa.

[73] Assignee: E. I. Du Pont de Nemours and Company, Wilmington, Del.

[21] Appl. No.: 631,383

[22] Filed: Jul. 16, 1984

[51] Int. Cl.[4] ..... H01R 4/24

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 2,802,083 | 8/1957 | Lapeyre | 339/99 R |
| 3,596,232 | 7/1971 | Medley | 339/99 R |
| 3,708,779 | 1/1973 | Enright et al. | 339/99 R |
| 3,772,635 | 11/1973 | Frey et al. | 339/99 R |
| 4,153,325 | 5/1979 | Asick . | |
| 4,416,501 | 11/1983 | Fusselman et al. . | |

*Primary Examiner*—Joseph H. McGlynn

[57] ABSTRACT

A connector for establishing electrical contact with a high count twisted pair cable is formed of a wiring block which telescopes into a receptacle. The leading edge of the wiring block in conjunction with the scalloped trailing edge of the receptacle forms a shear for cutting the conductors assembled in the wiring block to length.

1 Claim, 4 Drawing Figures

10
12
20
24
26
27
29
30
31

CONNECTOR FOR ESTABLISHING ELECTRICAL CONTACT WITH A HIGH COUNT TWISTED PAIR CABLE

BACKGROUND OF THE INVENTION

This invention relates to an electrical connector for a high count twisted pair cable and more particularly to a connector for electrically and mechanically terminating such a cable.

Numerous connectors have been disclosed in the prior art for electrically and mechanically terminating high pair count cable. For example, Fusselman et al. in U.S. Pat. No. 4,416,501 discloses a multiconductor cable inserted into a wiring block. The conductors are assembled on precise centers and mass terminated by tined plugs mounted in a receptacle which with the wiring block form the connector. In assembling this type of cable connector, the ends of the conductors must be trimmed to length in an additional operation prior to assembly. One way to do this is by placing the connector in a press assembly having a pair of cutoff blades which shear off the conductors when the press is actuated as described in U.S. Pat. No. 4,153,325.

SUMMARY OF THE INVENTION

In accordance with the present invention, there is provided an electrical connector for a high count twisted pair cable. The connector comprises two pieces, one piece is a wiring block into which the conductors of the cable are inserted on precise centers. It telescopes within the other piece which includes insulation piercing devices to engage the conductors and a cutting edge for trimming the ends of the conductors protruding from the wiring block to length as the two pieces are telescoped together into a single unit connector.

DETAILED DESCRIPTION OF THE PREFERRED EMBODIMENT

Figure 1:
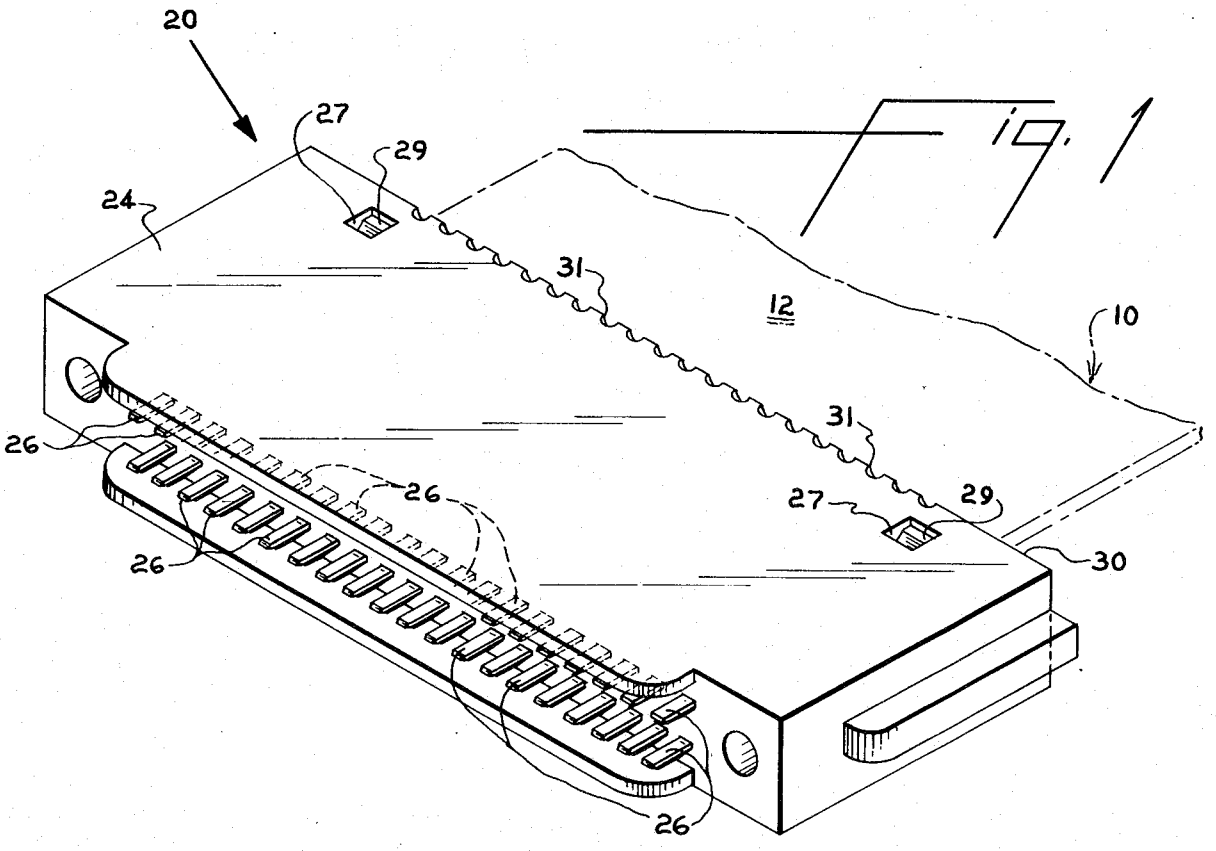
FIG. 1 is a perspective view of the cable connector of this invention.
Figure 2:
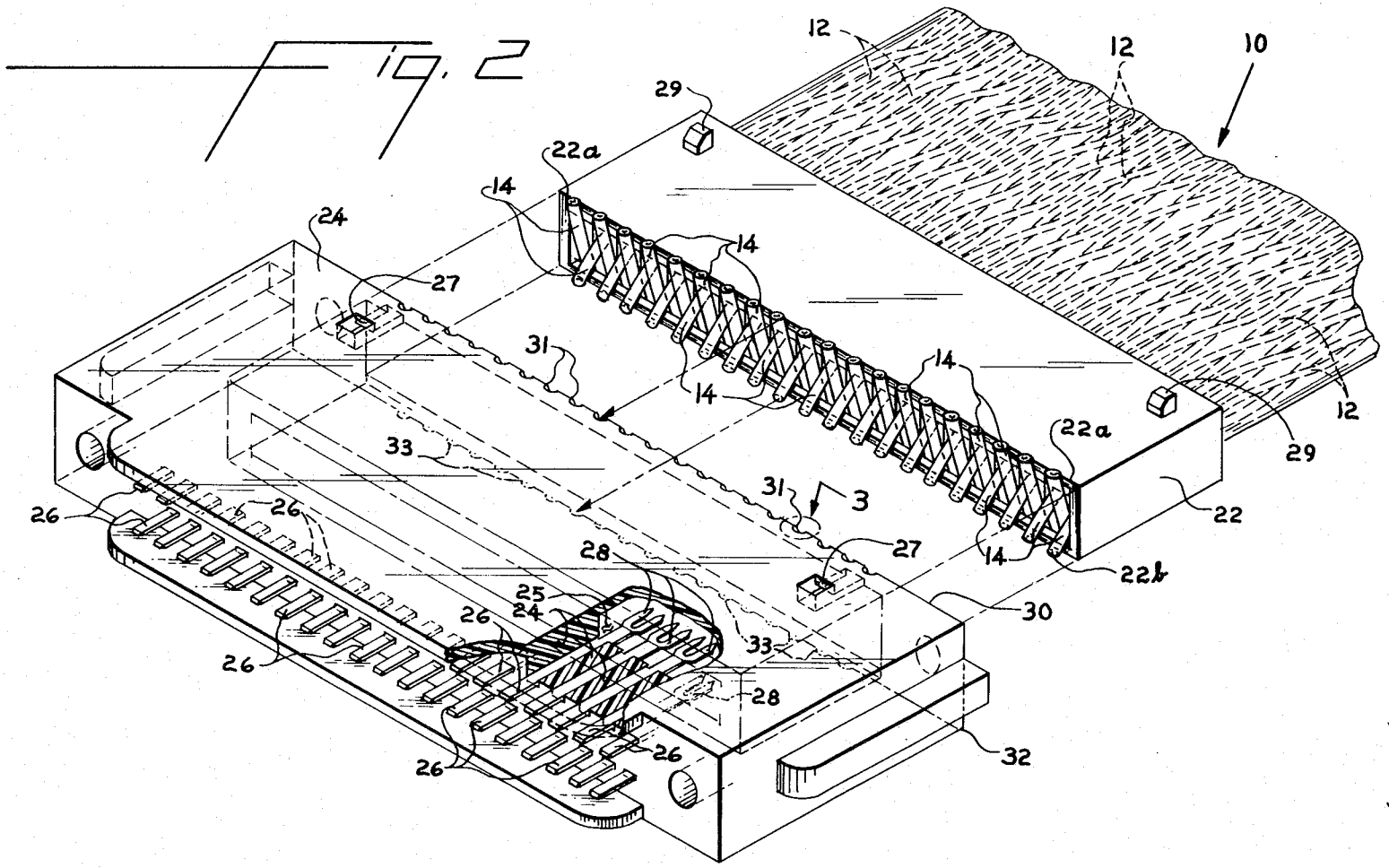
FIG. 2 is an exploded perspective view showing a segment of cable inserted in the wiring block prior to termination in the receptacle.
Figure 3:
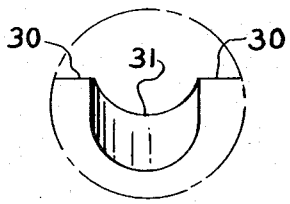
FIG. 3 is an enlarged view of a portion of the cutting edge of the receptacle.

Referring now to FIGS. 1–4, a multiconductor cable 10 includes a plurality of twisted pairs 12 of insulated conductors 14. The twisted pairs are fixed in a substantially parallel array in the form of a ribbon by means of a coating of Teflon ® fluorocarbon 16 completely surrounding each of the twisted pairs of conductors. Where the conductors 14 are to be terminated, the cable 10 is prepared by removing the Teflon ® coating from the end of the cable, exposing twisted pairs 12. The pairs 12 are untwisted and straightened, then loaded into a wiring block.

The connector 20 comprises a two pieces; one piece, the wiring block, is designated 22. The other piece, the receptacle, is designated 24 and includes a plurality of conductive blades 26 having insulation piercing tines 28 at one end. The tined end 28 of the blades extend into the open ended cavity 25 of the receptacle 24 into which the wiring block 22 is telescoped. The receptacle has openings 27 into which the interlock tabs 29 snap when the wiring block is fully inserted into the cavity of receptacle. An important feature of the receptacle 24 is trailing edges 30, 32, adjacent to the opening into cavity 25, of the receptacle. Edges 30, 32, are formed into a plurality of scalloped cutting edges 31, 33.

Figure 4:
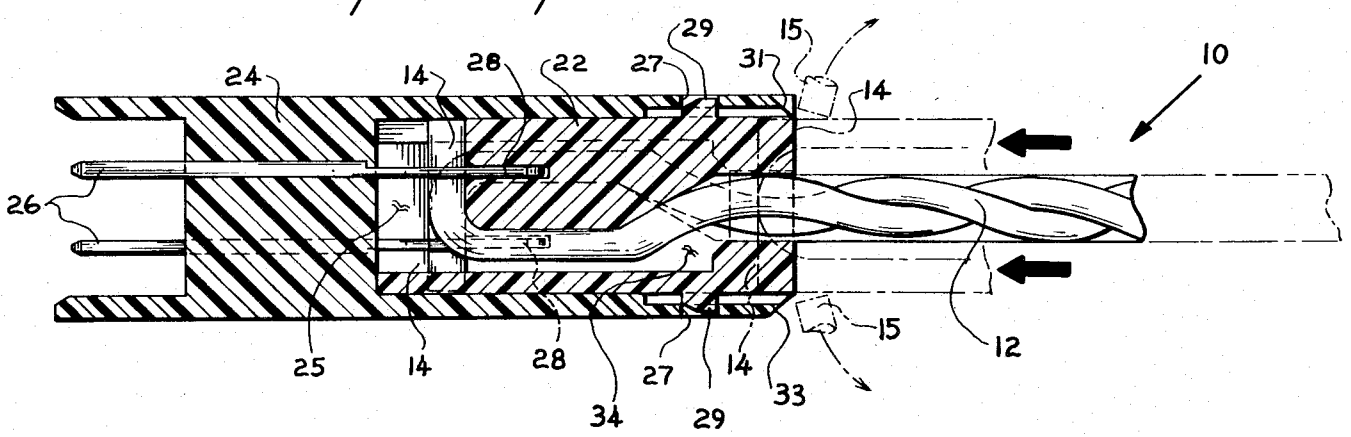
FIG. 4 is a cross-sectional view of FIG. 1, slightly enlarged, taken along line 4—4.

The connector 20 is assembled by first inserting the prepared end of cable 10 into wiring block 22 each conductor 14 of the cable is loaded through appropriate holes 34 in the wiring block and directed alternately upwardly or downwardly. The wiring block is then forced toward and into the cavity 25 of receptacle 24 with the ends of insulated conductors 14 extending above and below wiring block. As can be seen in FIG. 4, the abrupt edge defined at the intersection of scalloped cutting edges 31, 33 and trailing edges **22*a*, 22*b* of the top and bottom surfaces of the wiring block will shear the unwanted end portion 15 from the insulated conductor 14. Simultaneously, the insulation around the conductor 14 is being pierced by the tined end 28 of blade 26 to make electrical contact with conductor 14. Thus the twisted pair conductors 14 are both cut to length and electrical contact is made with blades 26**.

I claim:

1. A connector for establishing electrical contact with the conductors of a twisted pair cable comprising a receptable having a cavity with an opening into which a wiring block telescopes, said receptacle having a plurality of conductive insulation piercing devices fixed thereto extending into said cavity, said receptacle having a trailing edge formed into a plurality of scalloped cutting edges, said writing block having a leading edge, said conductor being inserted into said wiring block and extending above said leading edge, said leading edge of said wiring block intersecting with said scalloped edges to form a shearing edge as said wiring block is inserted into said cavity whereby the portion of said conductors above said leading edge are sheared off outside said connector.

* * * * *